US005271339A

United States Patent [19]

Yamagishi et al.

[11] Patent Number: 5,271,339

[45] Date of Patent: Dec. 21, 1993

[54] COMBUSTION APPARATUS FOR A REFUSE INCINERATOR

[75] Inventors: Miki Yamagishi; Sadao Suzuki; Shigeyuki Doi, all of Kawasaki, Japan

[73] Assignee: NKK Corporation, Tokyo, Japan

[21] Appl. No.: 788,595

[22] Filed: Nov. 6, 1991

[30] Foreign Application Priority Data

Nov. 16, 1990 [JP] Japan ..... 2-310851

[51] Int. Cl.[5] ..... F23H 7/08; F23H 7/14

[52] U.S. Cl. ..... 110/281; 110/283; 110/291; 126/167

[58] Field of Search ..... 432/77, 78; 110/208, 110/218-284; 126/167, 175

[56] References Cited

U.S. PATENT DOCUMENTS

| | | | |
|---|---|---|---|
| 2,282,157 | 5/1942 | Bennett | 110/291 |
| 2,391,578 | 12/1945 | Laurence | 110/291 |
| 4,103,627 | 8/1978 | Mainka | 110/281 |
| 4,200,047 | 4/1980 | Knorr | 110/281 |
| 4,463,688 | 8/1984 | Andreoli | 110/281 |
| 4,494,469 | 1/1985 | deSilva Pinto | 110/281 |
| 4,512,266 | 4/1985 | Shigoki | 110/283 |
| 4,676,176 | 6/1987 | Bonomelli | 110/291 |

*Primary Examiner*—Henry C. Yuen
*Attorney, Agent, or Firm*—Keck, Mahin & Cate

[57] ABSTRACT

A combustion apparatus for a refuse incinerator has a plurality of rows of grates arranged in parallel in the directions of breadth and in series in the longitudinal directions of a combustion zone and a post-combustion zone of the combustion apparatus. The rows consist of immobile grates and mobile grates alternately arranged. Immobile girders support the immobile grates. Mobile girders support the mobile grates. A partition wall divides the combustion apparatus into the combustion zone and the post-combustion zone. Seals cooperates with the mobile girders and are located on the partition wall. A hydraulic cylinder shuttles the mobile girders. Bearing housings are mounted on upper protrusions of the mobile girders holding the mobile grates so as to be able to vibrate. The engagement between the bearing housing and the mobile grates in the post-combustion zone allows play in the direction of driving the mobile girders so that the working stroke of the mobile grates in the post-combustion zone is shorter than the working stroke of the mobile grates in the combustion zone.

2 Claims, 3 Drawing Sheets

COMBUSTION APPARATUS FOR A REFUSE INCINERATOR

BACKGROUND OF THE INVENTION

1. Field of the Invention

The present invention relates to a combustion apparatus for a refuse incinerator.

2. Description of the Related Art

Conventionally, a combustion apparatus for a refuse incinerator has been generally composed of drying grates 21, combustion grates 22 and post-combustion grates 23 as shown in FIG. 3. In this apparatus, the drying grates 21, combustion grates 22 and post-combustion grates 23 are driven by independent driving sources respectively.

As shown in FIG. 4, attempts are made to reduce the cost of combustion by causing the combustion grates 22 to have the same function as that in a post-combustion zone with increase of the combustion rate of grates.

The combustion grates 22 are composed of mobile grates 4 and immobile grates 5. A plurality of rows of the mobile grates 4 and immobile grates 5 are alternately arranged in the direction of the breadth of the combustion apparatus of the incinerator. The mobile grates 4 are mounted on mobile girders 6 which are shuttled by a hydraulic cylinder 9. The immobile grates 5 are mounted on the immobile girders 7. Refuse is successively transferred by the shuttling motion of the mobile grates 4 toward the downstream side, and during transferring of the refuse, the refuse is combusted.

In this case, since the transferring speed of the refuse in the combustion zone at the front stage of the combustion apparatus is equal to that in the post-combustion zone at the rear stage of the combustion apparatus, the accumulation of the refuse or ash in the post-combustion zone becomes extremely small. As a result, the grates are exposed in the incinerator.

Therefore, there have occurred problems that the temperature of the grates is extraordinarily enhanced by heat radiation of combusting gases inside the incinerator, that molten metals stick to the surfaces of the grates, and that emergency stop of the operation of the combusting apparatus is caused by decrease of service life of the grates or by sticking of the grates to each other.

SUMMARY OF THE INVENTION

The present invention is intended to solve the aforementioned problems and it is an object of the present invention to provide a combustion apparatus for a refuse incinerator wherein the service life of grates of the combustion apparatus cannot be decreased or the grates cannot stick to each other due to the extraordinary increase of the temperature of the grates under the influence of heat radiation of gases inside the incinerator.

To attain the aforementioned object, the present invention provides a combustion apparatus for a refuse incinerator, comprising:

a plurality of rows of grates arranged in parallel in the directions of breadth and in series in the longitudinal directions of a combustion zone and a post-combustion zone of the combustion apparatus;

rows of immobile grates and mobile grates composing said plurality of rows of grates and alternately arranged in the direction of breadth;

immoblile girders, on which said immobile grates are mounted;

mobile girders, on which said mobile grates are mounted;

a partition wall dividing the combustion apparatus into the combustion zone and the post-combustion zone;

seal portions of said mobile girders arranged adjcent to said partition wall;

a hydraulic cylinder shuttling said mobile girders;

bearing housings mounted on upper protruding portions of the mobile girders and holding the mobile grates as being able to vibrate;

engaging portions which are mounted on the mobile grates in the combustion zone and with which the bearing housings are engaged;

engaging portions which are mounted on the mobile grates in the post-combustion zone and which hold the bearing housings as being able to slide; and spaces for play which are arranged between the engaging portion and the bearing housing in the direction of driving the mobile girders.

The above objects and other objects and advantages of the present invention will become apparent from the following detailed description, taken in conjunction with the appended drawings.

DESCRIPTION OF THE PREFERRED EMBODIMENT

A partition wall is arranged between a combustion zone and a post-combustion zone in a combustion apparatus for a refuse incinerator. It is for the purpose of blowing different amounts of air into both the combustion zone and the post-combustion zone that the partition wall is provided between the combustion zone and the post-combustion zone. The position of the partition wall varies depending on the nature of refuse. In recent years, the combustion speed of refuse in a refuse incinerator has been increased due to an increase of calorie of the refuse. In consequence, a method has been adopted wherein refuse is combusted on grates in one stage in a full combustion zone. However, refuse is substantially completely combusted on the grates in one stage, whereas the accumulation of ash becomes small and unburnt refuse remains at the rear end portion of the grates. The nature of the refuse is very bad and the refuse cannot be converted to a complete ash. Therefore, the grates are divided into two zones, namely, a combustion zone in the front portion of the refuse incinerator and a post-combustion zone in the rear portion of the incinerator, and the moving speed of the grates is made relatively quick in the combustion zone while the moving speed of the grates in the post-combustion zone is made slow in comparison with the moving speed of the grates in the combustion zone. A small amount of air is blown into the post-combustion zone in comparison with that in the combustion zone. In consequence, the accumulation of ash in the post-combustion becomes larger than before whereby the grates in the post-combustion zone can be prevented from being damaged without being exposed to the air.

The transferring speed of the refuse in the post-combustion zone is decreased by causing a working stroke of a mobile grate in the post-combustion zone to be smaller than a working stroke of a mobile grate in the combustion zone.

In this way, the accumulation of refuse or ash on the grates in the post-combustion zone is increased, whereby the grates are prevented from being exposed in the incinerator.

EXAMPLE

Figure 1:
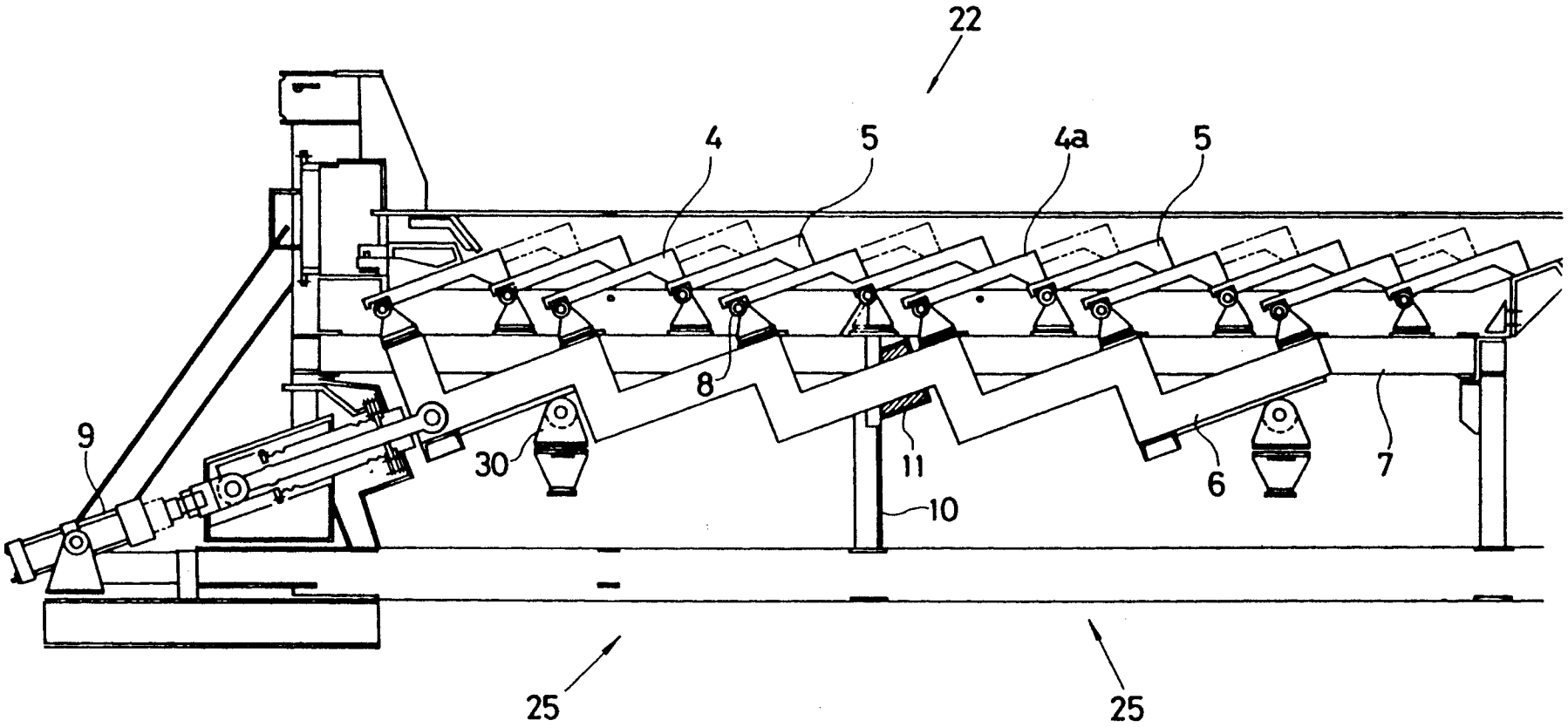
FIG. 1 is an explanatory view showing an example of a combustion apparatus for a refuse incinerator of the present invention.
Figure 2:
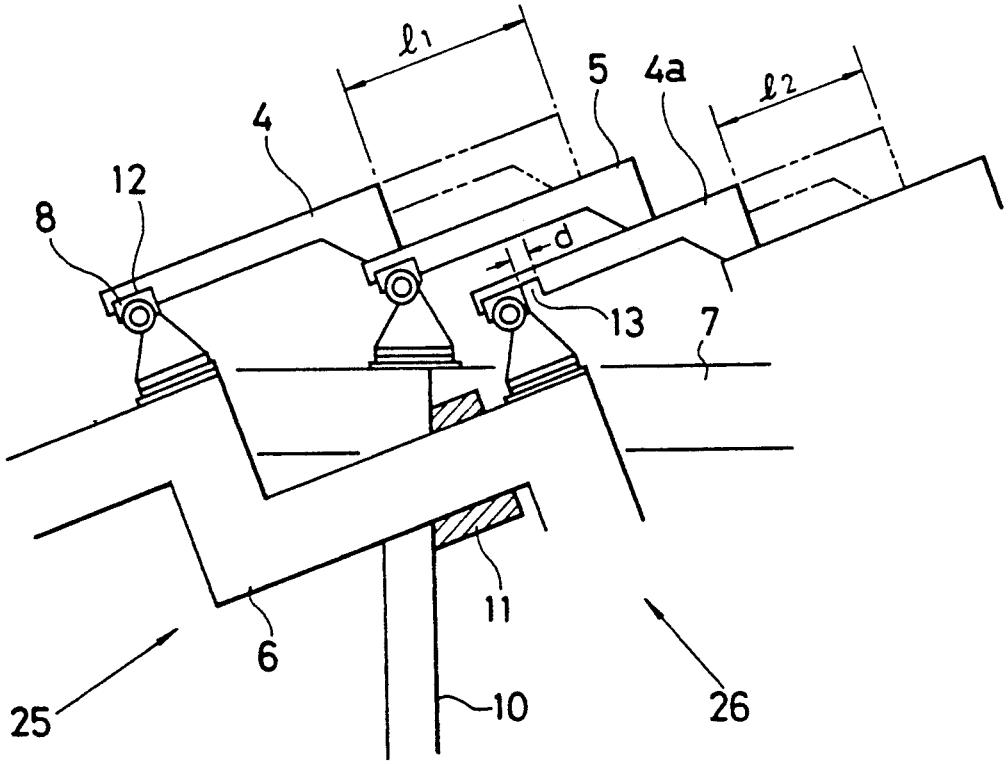
FIG. 2 is an enlarged explanatory view of the combustion apparatus for a refuse incinerator of the present invention.
Figure 3:
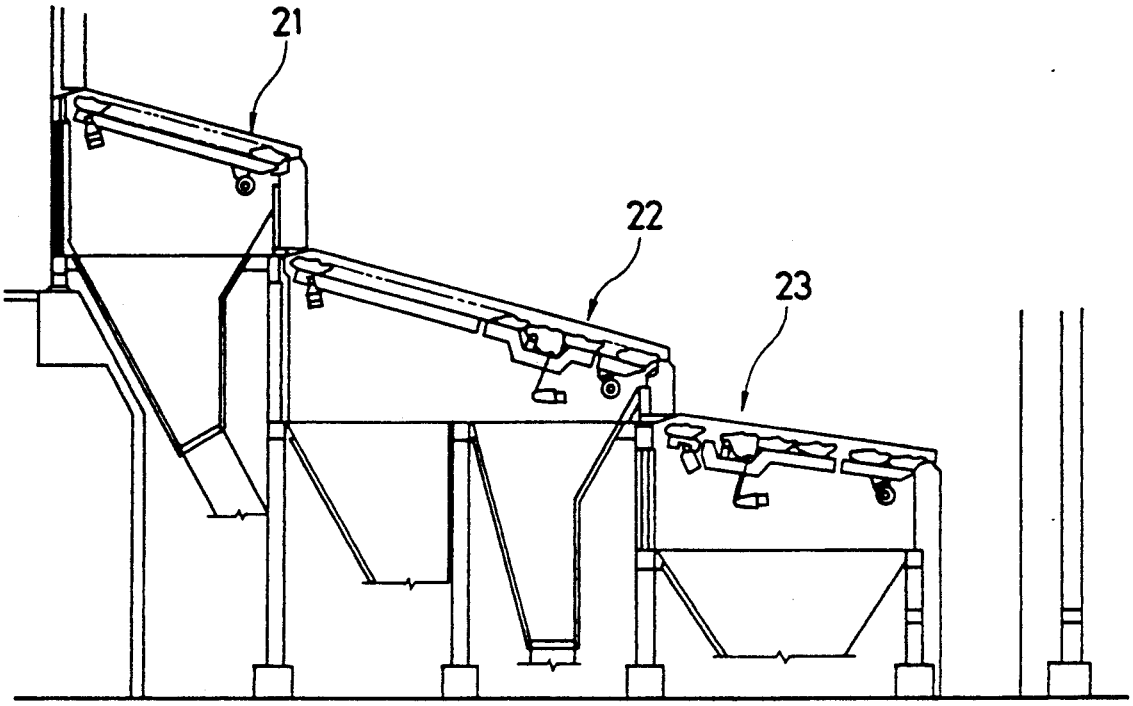
FIG. 3 PRIOR ART
FIGS. 3 and 4 are explanatory views of the prior art combustion apparatuses.
Figure 4:
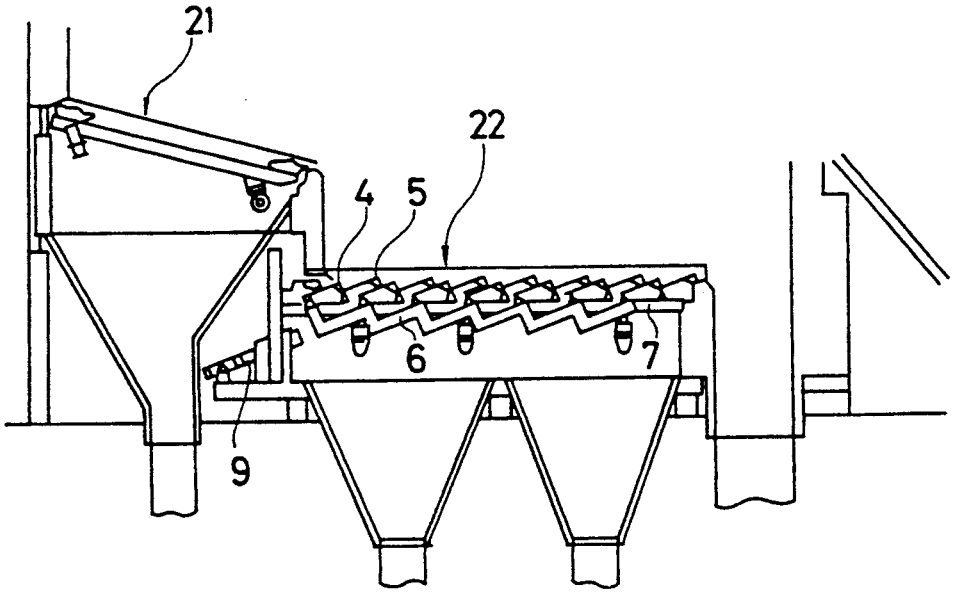
FIG. 4 PRIOR ART

An example of the present invention will now be described with specific reference to FIGS. 1 and 2.

A combustion apparatus for a refuse incinerator is divided into a combustion zone 25 and a post-combustion zone 26 by a partition wall 10. A seal portion 11 cooperating with a mobile girder 6 is arranged adjacent to and mounted on the partition wall 10.

Combustion grates 22 are composed of mobile grates 4 and immobile grates 5. A plurality of rows of the mobile grates 4 and immobile grates 5 extending in the longitudinal direction are alternately arranged in parallel in the direction of breadth. The mobile grates 4 are mounted on the mobile girder 6 by means of bearing housing 8 which is connected to and drives the girder 6. The mobile girders are shuttled by a hydraulic cylinder 9 which is connected to and drives the girder 6. Refuse is successively transferred by a shuttling motion of the mobile grates 4 relative to immobile grates 5 toward the downstream side of the combustion apparatus as shown in FIG. 1.

During transferring of the refuse, the refuse is combusted. The girders 6 are supported on rollers 30 mounted on the frame or foundation.

The bearing housing 8 holding each mobile grate 4 is mounted on an upper protruding portion of the mobile girder 6. The mounting allows grate 4 to be able to vibrate in a known manner. An engaging portion 12, with which the above-mentioned bearing housing 8 is engaged, is formed on the lower bottom end of each mobile grate 4 in the combustion zone 25. The mobile grate 4 is shuttled with stroke $l_1$ corresponding to the working stroke of the mobile girder 6 as shown in FIG. 2.

An engaging portion 13, with which the above-mentioned bearing housing 8 is engaged, is formed on the lower bottom end of each mobile grate **4*a* in the post-combustion zone 26. The engaging portion 13 provides a space "d" for play between the engaging portion and the bearing poriton 8 in the direction of driving the mobile girders 6. Thus, the engaging portion 13 first slides freely relative to bearing housing 8 until housing 8 has moved a distance equal to space "d" whereupon further movement of housing 8 in the driving direction causes housing 8 to engage mobile grate 4*a*** and effect its stroke.

In this way, the working stroke $l_2$ of the mobile grate in the post-combustion zone is made smaller than the working stroke $l_1$ of the mobile grate in the combustion zone 25, whereby the transfer speed of refuse in the post-combustion zone 26 becomes smaller than the transfer speed of refuse in the combustion zone 25.

What is claimed is:

1. A combustion apparatus for a refuse incinerator, comprising:

a combustion housing divided into a combustion zone and a post-combustion zone;

a plurality of rows of grates arranged in parallel in the directions of breadth and in series in the longitudinal directions of the combustion zone and the post-combustion zone of the combustion apparatus;

rows of immobile grates and mobile grates composing said plurality of rows of grates with the rows being alternately arranged in the longitudinal direction;

immobile girders, on which said immobile grates are mounted;

mobile girders, on which said mobile grates are mounted to effect working strokes thereof to advance refuse through the combustion apparatus;

a partition wall dividing the combustion apparatus into the combustion zone and the post-combustion zone;

seal portions for said mobile girders arranged adjacent to said partition wall;

a hydraulic cylinder shuttling said mobile girders;

bearing housings mounted on upper protruding portions of the mobile girders and engaging the mobile grates so as to be able to vibrate;

engaging portions defined on the mobile grates in the post-combustion zone which enable the associated bearing housings to slide relative to the mobile grates in the direction of driving the mobile girders before engaging and effecting the strokes of the mobile grates;

wherein said mobile grates are shuttled with stroke $l_1$ corresponding to a working stroke of the mobile girders, and the working stroke $l_2$ of each mobile grate in the post-combustion zone is smaller than the working stroke $l_1$ of the mobile grate in the combustion zone.

2. The combustion apparatus for a refuse incinerator of claim 1, wherein said partition wall controls the amount of air in each of the combustion zone and the post-combustion zone.

* * * * *